US005990579A

United States Patent [19]

Ricci

[11] Patent Number: 5,990,579

[45] Date of Patent: Nov. 23, 1999

[54] REMOTE CONTROLLED DOOR STRIKE PLATE

[76] Inventor: Russell L. Ricci, 193 Kitemaug Rd., Uncasville, Conn. 06382

[21] Appl. No.: 09/054,958

[22] Filed: Apr. 3, 1998

[51] Int. Cl.[6] ..... E05B 15/02

[52] U.S. Cl. ..... 307/117; 292/341.16

[58] Field of Search ..... 307/117, 10.2–10.5; 361/173, 175, 176, 182–184; 340/825.69, 825.72; 292/341.16, 341.15, 201, DIG. 25, 340, 144

[56] References Cited

U.S. PATENT DOCUMENTS

| | | | |
|---|---|---|---|
| 2,509,345 | 5/1950 | Howell et al. . | |
| 3,184,937 | 5/1965 | Sher . | |
| 3,564,501 | 2/1971 | Flook, Jr. . | |
| 3,638,984 | 2/1972 | Davidson | 292/341.16 |
| 3,659,154 | 4/1972 | Finn . | |
| 3,733,861 | 5/1973 | Lester . | |
| 3,939,679 | 2/1976 | Barker et al. . | |
| 4,211,443 | 7/1980 | Butts et al. | 292/341.16 |
| 4,340,799 | 7/1982 | Ueda et al. . | |
| 4,426,733 | 1/1984 | Brenig . | |
| 4,449,189 | 5/1984 | Feix et al. . | |
| 4,450,545 | 5/1984 | Kishi et al. . | |
| 4,472,617 | 9/1984 | Ueda et al. . | |
| 4,602,256 | 7/1986 | Kago et al. . | |
| 4,697,171 | 9/1987 | Suh | 307/10.5 |
| 4,961,177 | 10/1990 | Uehara . | |
| 4,986,584 | 1/1991 | Logas | 292/341.16 |
| 5,076,625 | 12/1991 | Oxley | 292/341.16 |
| 5,127,691 | 7/1992 | Herron et al. | 292/341.16 |
| 5,136,548 | 8/1992 | Claar et al. . | |
| 5,219,196 | 6/1993 | Luker | 292/341.16 |
| 5,265,191 | 11/1993 | McNair . | |
| 5,371,901 | 12/1994 | Reed et al. . | |
| 5,432,495 | 7/1995 | Tompkins . | |
| 5,484,180 | 1/1996 | Helmar | 292/341.16 |
| 5,693,987 | 12/1997 | Krucoff | 307/10.2 |
| 5,735,559 | 4/1998 | Frolov | 292/341.16 |
| 5,757,269 | 5/1998 | Roth et al. | 292/341.16 |

FOREIGN PATENT DOCUMENTS

| | | |
|---|---|---|
| 56-88506 | 7/1981 | Japan . |
| 91-273111 | 11/1989 | Japan . |

OTHER PUBLICATIONS

Barnes, Lawrence D., Automated System for Controlling Authorization, Identification, and Entry into Nuclear Facilities May 13–15, 1981, 1981 Carnahan Conference on Crime Countermeasures, University of Kentucky, Lexington, Kentucky.

*Primary Examiner*—Richard T. Elms
*Attorney, Agent, or Firm*—Gene Scott-Patent Law & Venture Group

[57] ABSTRACT

A remotely controllable door lock actuating device has a door strike that is actuated by a solenoid which is controlled by an electrical circuit responsive to a remote energy signal. The electrical circuit causes a solenoid to manipulate the door strike, causing the door strike to move between a door locking position and a door unlocking position. In the door locking position, the door strike engages a conventional spring-biased door bolt. In the door unlocking position, the door strike changes its position to release the bolt. The invention may be powered by household electric current and may include a switch to deactivate it.

14 Claims, 2 Drawing Sheets

REMOTE CONTROLLED DOOR STRIKE PLATE

BACKGROUND OF THE INVENTION

1. Field of the Invention

This invention relates generally to door locks, and more particularly to a remote controlled door strike plate enabling the door to function as a conventional door with key access, or under remote control.

2. Description of Related Art

The following art defines the present state of this field:

E. N. Howell et al, U.S. Pat. No. 2,509,345 the present invention relates to remote control devices and particularly to a remote control utilizing a supersonic wave as the means for causing the control devices to function. It is the primary object of the invention to provide remote control devices whereby a motor vehicle operator approaching his garage may cause the garage doors to open without leaving the seat of the automobile and without the need of any physical connection between the vehicle and the door mechanism.

I. H. Sher, U.S. Pat. No. 3,184,937 relates to a new and improved voice controlled lock mechanism and, more particularly to a lock which will be responsive to one or more selected persons voice and which will obviate the need for coded mechanical devices such as keys. The present invention utilizes a vibrating optic fiber unit to activate a switch closing a circuit on a servo motor which withdraws the bolt of a lock.

Flook, Jr., U.S. Pat. No. 3,564,501 describes an electronic actuating arrangement includes both triggering means for operating an actuating device such as to permit the opening of a door, and lockout means for preventing operation of the triggering means in the absence of an input signal of precisely predetermined frequency or in the presence of incorrect signals. An amplifier is provided which may incorporate a quartz crystal resonator filter which has either a peak or a null characteristic at a predetermined frequency. When the resonator has the null characteristic, the filter is used in the lockout channel of the arrangement. When it has the peak characteristic the filter is used in the actuate channel.

Finn, U.S. Pat. No. 3,659,154 describes in an electronic lock and alarm system, a sequence of digitally coded signals, specified by logically comparing input coded signals from a manually operated selector matrix and preset coded signals from a programmable code detector, is transmitted to a sequence recognizer computer for determining the validity of the coded sequence, and terminals such as door locks, ignition switches, etc., are operated by the computer in one of several modes specified by a user discriminatingly operating the selector matrix. In a first mode, the terminals are opened for accessibility to the user. In a second mode, the terminals are closed for inaccessibility to the user and a main alarm in the immediate vicinity is energized. In an optional third mode, the terminals are opened for accessibility to the user and a silent alarm is energized at a remote location.

Lester, U.S. Pat. No. 3,733,861 describes an electronic, door lock controlled by a passive transponder used as a key by the person desiring to open the door. A hand-operated electric generator is coupled by a gearing system to the door handle, and generates power to operate a door lock transceiver which receives coded signals from the personal transponder to open the lock. Upon the reception of properly coded signals, a solenoid is activated to withdraw an abutment member from the path of a laterally slidable door bolt mechanism so that the door may be opened. The personal transponder may be disposed within a watch case, or have the size and shape of a conventional writing pen. The system may be radio frequency or ultrasonic.

Barker et al., U.S. Pat. No. 3,939,679 describes normally disabled electrical and mechanical devices are caused to be enabled to operate by remote control signals having predetermined distinctive characteristics, such signals originating from enabling control equipment transported by an authorized person or persons. Receiving equipment providing output enabling signals only in response to received signals having the predetermined distinctive characteristics is preferably mad integral with the mechanical or electrical devices involved and is coupled through appropriate electronic or electromechanical devices to the disabling means in the mechanical or electrical devices to be enabled.

Ueda et al., U.S. Pat. No. 4,340,799 describes a heating apparatus, such as an electric oven or a microwave oven, comprises an enclosure case having therein a heating chamber to place a heating object therein, the enclosure case having a door at an opening of the chamber, and the door having a locking means, to lock the door when closed, and has a door lock releasing means, such as a lever and a solenoid planger, to release and open the door from the locking state of the locking means, a voice recognition circuit for recognizing voice commands of a user of the apparatus and produces at least a control signal, which drives the releasing means to open the door.

Brenig, U.S. Pat. No. 4,426,733 describes a voice-controlled, operator-interacting radio transceiver has a transceiver for transmitting and receiving radio frequency signals under plural potential operating conditions including on/off, transmit/receive, frequency of operation, squelch, volume control, etc. A speech recognition circuit receives audible verbal phrases spoken by a human operator and produces control signals in response to certain predetermined recognized phrases. The operation of the transceiver is controlled in response to the control signals and further coded data signals representative of the respective predetermined operating condition of the transceiver are also produced. Output devices are responsive to the further coded data signal for producing an output signal perceptible to the human operator and confirmatory of the control action then being effected.

Feix et al., U.S. Pat. No. 4,449,189 describes a method and an apparatus are disclosed for identifying an individual through a combination of both speech and face recognition. The voice signature of an interrogated person uttering a key word into a microphone is compared in a pattern matcher with the previously stored voice signature of a known person uttering the same key word to obtain a first similarity score. At the same time, when a key event in the utterance of the key word by the interrogated person occurs, a momentary image of that person's mouth region onto which a grid pattern has been projected is optically recorded and compared with the previously stored corresponding momentary image of the same known person to obtain a second similarity score. The two similarity scores are analyzed to verify that the identity of the interrogated person is that of the known person.

Kishi et al., U.S. Pat. No. 4,450,545 describes a voice responsive door lock system is provided wherein the operation of the door lock device is vocally controlled by the driver via a voice recognition unit. The voice responsive door lock system for a motor vehicle comprises a door position detection means, an indication means for indicating a question as to the necessity of locking the door, a voice recognition unit for identifying the driver's reply and producing a door lock command signal, and a door lock control means for actuating a door lock device upon receiving the door lock command signal.

Ueda et al., U.S. Pat. No. 4,472,617 describes a heating apparatus, such as an electric oven or a microwave oven, comprises an enclosure case having therein a heating chamber to place a heating object therein, the enclosure case having a door at an opening of the chamber, and the door having a locking means, to lock the door when closed, and has a door lock releasing means, such as a lever and a solenoid planger, to release and open the door from the locking state of the locking means, a voice recognition circuit for recognizing voice commands of a user of the apparatus and produces at least a control signal, which drives the releasing means to open the door.

Kago et al., U.S. Pat. No. 4,602,256 describes a luggage door unlocking device for a vehicle, by which a luggage door of the vehicle can be unlocked without using an unlocking key, is disclosed. The device comprises a portable transmitter for generating an unlocking signal of ultrasonic wave, an ultrasonic wave receiver which is mounted on the vehicle and which receives an ultrasonic wave from the portable transmitter, a discriminating means for subjecting the signal received by the ultrasonic wave receiver to waveform shaping to obtain a high-frequency pulse train and detecting a high-frequency pulse train of a predetermined pattern to obtain the unlocking signal and an unlocking mechanism for unlocking the luggage door of the vehicle upon receipt of the unlocking signal after discrimination by the discriminating means. The transmitter has a power supply switch which is enclosed in a case having a clip for attachment to the clothes of the person who carries the transmitter and which is closed upon attachment of the clip to the clothes.

Uehara, U.S. Pat. No. 4,961,177 describes an apparatus and method for inputting a voice through a microphone mounted at a position facing a speaking person. An image of a speaking person is generated and used to detect the position of a mouth of the speaker. The microphone is then moved in accordance with position of the mouth.

Claar et al., U.S. Pat. No. 5,136,548 describes a remote-controlled system for closures with a movable hand transmitter with at least one transmission key, this transmitter generating and radiating directed coded control signals upon actuation of the transmission key of the hand transmitter. At least one first receiver unit is tuned to receive the control signals radiated from the hand transmitter and is arranged on a motor vehicle and triggers switching effects on a remotely controllable vehicle locking after the received control signals have been identified as acceptable. At least one second receiver unit is tuned to receive control signals radiated as a result of the actuation of the transmission key of the hand transmitter for remotely controlling a remotely controllable access control device external to the motor vehicle. The second receiver unit is arranged outside the motor vehicle and triggers switching effects on the access control device after the received control signals have been identified as acceptable. An electrical circuit is provided for preventing at least the triggering of switching effects by the second receiver unit when the control signal radiated as a result of a single actuation of the transmission key of the hand transmitter is received simultaneously by the first and the second receiver unit, by causing to arrive at the second receiver unit only a control signal which significantly differs from the control signal radiated as a result of the actuation of this transmission key of the hand transmitter for remotely controlling the access control device. At least one transmitter is fixed to the motor vehicle, this transmitter being randomly electrically activatable from a passenger space of the motor vehicle independently of the hand transmitter. The transmitter is arranged on the outside of the motor vehicle for direct radiation to the outside of control signals coded in accordance with the control signals radiated by the hand transmitter. This ensures that only one code has to be impressed on the control signals of the hand transmitter in order to make it possible to use the hand transmitter for the direct remote control both of the vehicle locking and of the access control device.

McNair, U.S. Pat. No. 5,265,191 describes a voice-based security system requires that a series of utterances to be uttered by the requester contain at least one repeated utterance. The system compares a representation of each instance of the repeated utterance as uttered by the requester to both a prestored template for the utterance and to each representation of the other instances of the utterance as uttered by said requester. The requester is authenticated only if each representation of the repeated utterance as uttered by said requester matches the prestored template and the representations of the repeated utterance as uttered by said requester do not match each other to such a high degree that they are deemed to have been mechanically generated.

Tompkins, U.S. Pat. No. 5,432,495 describes a beeper controlled auto security system in which a vehicle disabling device such as an ignition kill switch is selectively activated either by a hand held rf transmitter unit or a beeper paging system satellite transmission initiated by a telephone call which may be at a very remote location from the vehicle. A vehicle motion detector is also activated which turns on a monitor transmitter if the vehicle is thereafter moved, enabling detection by a portable monitor receiver carried by the vehicle owner or police vehicles.

Reed et al., U.S. Pat. No. 5,371,901 describes a portable communication device is controlled by voice recognition circuitry remote from the portable communication device. The portable communication device includes apparatus for producing and transmitting a parametric representation of voice commands. The remote circuitry (which could possibly be a base station, a mobile repeater, or simply a dedicated box, separate from the portable) produces control signals responsive to the parametric representation of voice commands, for controlling the portable communication device.

Shigeki Ueda, JP 56-88506, to enable a user to open the door of a heater without using his or her hand, by registering the feature extraction pattern of a voice, commanding door operation, in the standard pattern member of a voice recognition processing part.

Yoshio Takada, JP 1-273111 provides to control the terminal equipment by a voice by comparing the voice contents and the storage contents by a voice recognizing means and determining the command contents and executing a control of the terminal equipment corresponding to the command contents by a control part.

Lawrence D. Barnes, 1981 Carnahan Conference on Crime Countermeasures, University of Kentucky, Lexington, Kentucky, describes an automated access control system developed under contract to the Department of Energy at the Barnwell Nuclear Fuel Plant is described. This system enables the facility management to control who has access to sensitive areas at specific times, control the authority to grant access to individuals with cross-checks and verification, and provide positive identification of personnel obtaining entry, as well as an auditable record of all entry events.

The prior art teaches various mechanisms which remotely actuate the spring-biased bolt-type lock to unlock a door. However, the prior art does not teach a device that will unlock a door without modifying the door itself to carry the device that responds to remote signals. There is a great need for a device which can be installed in the frame of the door without altering the door itself. This is because a remote control device must be powered by electrical current, and facilitating such into a moving door presents considerable difficulty. If a battery is used, then it must be replaced periodically. If a wire is used to conduct current to the door then the problem of interconnecting the wire to the door is presented. The present invention overcomes these problems, and provides further related advantages as described in the following summary.

SUMMARY OF THE INVENTION

The present invention teaches certain benefits in construction and use which give rise to the objectives described below.

The present invention provides a solenoid operated door strike enabling the strike to move to a position where a standard spring loaded door bolt, or a deadbolt type bolt, may engage the strike for latching or locking the door in a closed position, and wherein the strike may be moved to a withdrawn position allowing the door to be unlatched or unlocked by remote control without turning the lock or the doorknob, and thereby allowing the door to be moved to an ajar position from the closed position.

A primary objective of the present invention is to provide a remote controlled door latching and locking device having advantages not taught by the prior art.

Another objective is to provide such a device that does not require a modification of a door or a door lock in order to function.

A further objective is to provide such a device that is quickly and easily installed in most existing doors.

A still further objective is to provide such a device so as to enable a door to be alternately unlocked by a key or by remote actuation.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above described drawing figures illustrate the invention, a remotely controllable door latching and locking device. It may be used with any standard door 5 such as is mounted for entry to a building, or for closing-off one room from another within a building. Conventionally, as is well known, a standard door is mounted on hinges in a door frame so that it is movable from a closed position within the door frame to an open position to one side or the other of the door frame. Mounted on the door frame is a strike plate which is fixed in place, and mounted in the edge of the door opposite the strike plate is a lock mechanism including at least one movable bolt which is movable between an extended position, extending outwardly from the door edge, and a withdrawn position wherein the bolt is positioned within the door and not extending outwardly therefrom. Usually this bolt is either spring loaded, so as to be biased in the extended position, or can be so positioned by moving a lock mechanism mounted in the door. Such a lock mechanism may be set to prevent the bolt from moving into the withdrawn position so that the door may be locked, i.e., with the bolt set into an aperture in the strike plate in the door jam. Clearly, with the bolt set into the strike plate, the door is not able to be moved. Keys and cards are typically used to lock and unlock such a door lock so as to enable the bolt to be withdrawn or extended. Typically, door are usually latched and also may be locked in the latched state. Latching is normally desirable since when a door is closed into the door jam, it is desired to maintain the door in such a closed position against drafts and such until it is opened for a reason such as having a person pass through the portal. Such a latching function is accomplished by spring loading the bolt so that it may automatically withdraw upon encountering the strike plate as the door is set in the closed position. When this occurs the bolt withdraws enough to allow the door to move to its fully closed position whereupon the bolt is moved opposite the aperture in the strike plate and therefore moves into the aperture engaging the strike plate. The door, then, is not able to move to the ajar position without purposefully withdrawing the bolt. With the door latched, it may be locked or not. Usually a turn of the door knob will suffice to disengage such a spring loaded bolt so that the door may be hinged open.

Figure 1B:
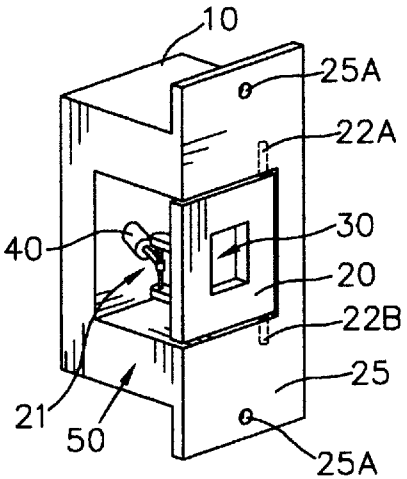
FIG. 1B is a perspective view of a door strike of the invention shown in a locked position.
Figure 1C:
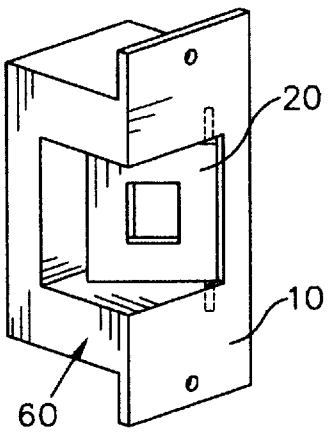
FIG. 1C is a perspective view of a door strike of the invention shown in an unlocked position.
Figure 1A:
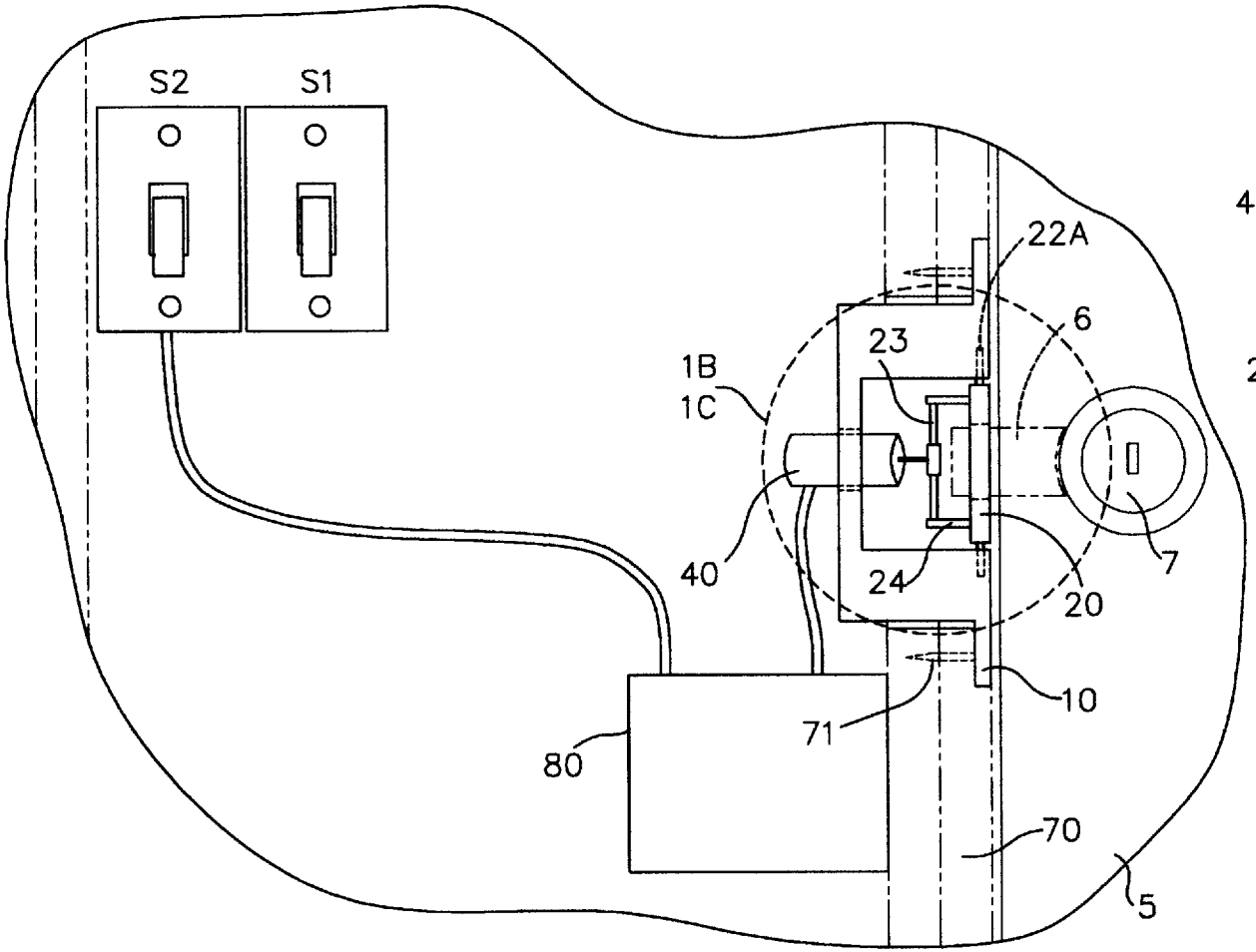
FIG. 1A is a front elevational view of the preferred embodiment of the present invention with a wall surface removed in order to show the elements of the invention.

Preferably the invention includes a door strike means 10 as seen in FIGS. 1B and 1C, providing a movable door strike plate 20 with a door bolt access aperture 30 within it. The door strike plate 20 cooperates with a strike plate mounting plate 25 which has a pair of mounting holes 25A for mounting the strike means 10 in door jam 70 with screws 71. An electromechanical actuation means 40, preferably an electrical solenoid, as best seen in FIGS. 1A and 1B, is operably interconnected with the door strike plate 20 through linkage 21 consisting of pivot rod 23 pivotally engaged at its ends by ears 24 which, in turn, are fixed to strike plate 20, the door strike plate 20 being hinged, at hinges 22A and 22B, so as to move between a door locking position 50, aligned with the strike plate mounting plate 25, and a door unlocking position 60 as driven by the actuation means 40.

Figure 2:
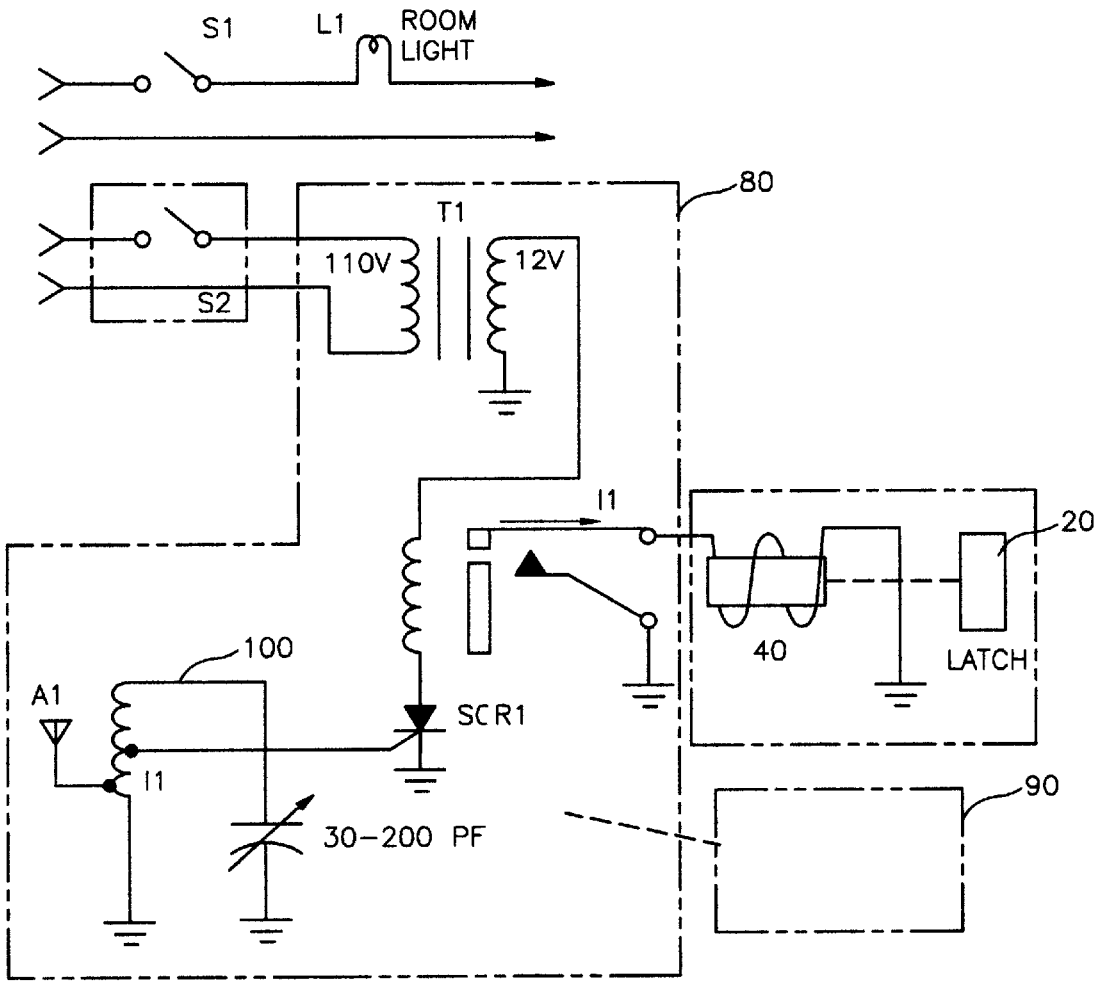
FIG. 2 is an electrical schematic diagram of the invention.

The invention further includes an electrical circuit 80, as shown in FIG. 2, having a wave energy signal receiving means Al, preferably an antenna such as a simple wire, a control signal generating means 100, preferably an LC circuit as shown in FIG. 2, which is coupled to the signal receiving means Al and is responsive thereto, a control means SCR1, such an a silicone controlled rectifier, for establishing an actuation current I1 in accordance with a control signal of the control signal generating means 100. The actuation current I1 is coupled to the actuation means 40 of the door strike means 10 so as to enable a position change of the strike plate 20 in accordance with the wave energy signal. Also shown in FIG. 2 is step-down transformer T1, nominally providing 12 volts AC from a 110 volt source, such as standard household wiring. Since a light switch S1 is typically mounted near most doors so that room light L1 may be switched on or off when entering or leaving a room respectively, it is a relatively easy task to provide a second switch S2, mounted on the same wall as switch S1, and deriving electrical power from the same power line as switch S1. Switch S2 is used to disable the remote control function of the present invention. Alternately, switch S2 may be discarded from the circuit of FIG. 2 so that the remote function may not be turned off. Electrical circuit 80, as described, is a well known garage door remote actuation type circuit of a simple type in order to identify the basic elements necessary to operate the invention, however such a circuit may be more complex containing elements for coding and decoding and for the elimination of circuit noise and for improving signal to noise ratio.

The wave energy signal may comprise radio waves, light waves, inaudible sound waves or any other form of wave energy. The invention requires a wave energy remote signaling device 90 such as a radio transmitter, UV light transmitter, or ultrasonic sound transmitter, as are well known in the art, and this remote device may be considered a part of the invention or as an ancillary device thereto.

In use, the invention operates as a conventional door when the strike plate 20 is in the locking position 50 as shown in FIG. 1B. In this case, the door 5 may be latched by simply closing it, if the door bolt 6 is a spring actuated type as is found on most doors. Latching occurs when the bolt 6 enters aperture 30. To unlatch the door 5, the bolt 6 is withdrawn by turning door knob 7 as is well known. The door 5 may also be locked by any conventional means if a door locking mechanism is present in the door 5. The door 5 may also be both unlatched and unlocked, regardless of the position of the bolt 6 or any locking mechanism in the door 5, by simply moving the strike plate 20 to the unlocking position 60 as shown in FIG. 1C, and as described in the enablement above. The door 5 may also be locked in its closed position, although ajar with bolt 6 in the extended and locked attitude, by simply closing the door 5 while the strike plate 20 is in the unlocked position 60 shown in FIG. 1C, and then subsequently moving the strike plate 20 to the locked position 50 as shown in FIG. 1B. It should be clear that in order for door bolt 6 to move out of, or into, the door strike means 10 while it is still in its extended position as shown in FIG. 1A, not only must the strike plate 20 be in the unlocking position 60, but also door jamb 70 must also be cut away on that side of the door strike means 10 through which the bolt 6 must swing. Such a cut away portion of the door jamb 70 need only be of such width as to allow the door bolt 6 to pass as the door is opened and closed.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A remotely controllable door locking device comprising:

a door strike means providing a door strike plate having a door bolt access aperture therein, and an electromechanical actuation means operably interconnected with the door strike plate, the door strike plate being hinged so as to move between a door locking position and a door unlocking position as driven by the actuation means; and an electrical circuit having a wave energy signal receiving means, and responsive thereto, an actuation means enabling the door strike means, so as to position the strike plate in accordance with the wave energy signal.

2. The apparatus of claim 1 wherein the wave energy signal comprises radio waves.

3. The apparatus of claim 1 wherein the wave energy signal comprises light waves.

4. The apparatus of claim 1 wherein the wave energy signal comprises inaudible sound waves.

5. The apparatus of claim 1 wherein the actuation means is a solenoid device.

6. The apparatus of claim 1 wherein the wave energy receiving means is an antenna.

7. The apparatus of claim 1 wherein the electrical circuit is an SCR device.

8. A combination door and a remotely controllable door locking device comprising:

a door having a bolt extendable therefrom;

a remotely controllable door locking device comprising:

i) a door strike means providing a door strike plate having a door bolt access aperture therein, and an electromechanical actuation means operably interconnected with the door strike plate, the door strike plate being hinged so as to move between a door locking position and a door unlocking position as driven by the actuation means so as to engage and disengage the bolt;

ii) an electrical circuit having a wave energy signal receiving means, a control signal generating means coupled to the signal receiving means and responsive thereto, a control means for establishing an actuation current in accordance with a control signal of the control signal generating means, the actuation current being coupled to the actuation means of the door strike means so as to enable a position change of the strike plate in accordance with the wave energy signal; and a transmitter device for transmitting a received wave energy signal.

9. The device of claim 8 wherein the wave energy signal comprises radio waves.

10. The device of claim 8 wherein the wave energy signal comprises light waves.

11. The device of claim 8 wherein the wave energy signal comprises inaudible sound waves.

12. The device of claim 8 wherein the actuation means is a solenoid device.

13. The device of claim 8 wherein the wave energy receiving means is an antenna.

14. The device of claim 8 wherein the control means is an SCR device.

* * * * *